United States Patent [19]

Benedick

[11] 4,263,259

[45] Apr. 21, 1981

[54] HATCH AND HATCH COVER FOR THERMAL REGENERATION APPARATUS

[75] Inventor: Edward H. Benedick, Morristown, N.J.

[73] Assignee: Regenerative Environmental Equipment Co., Inc., Morris Plains, N.J.

[21] Appl. No.: 40,987

[22] Filed: May 21, 1979

[51] Int. Cl.[3] ..... F23G 7/06

[52] U.S. Cl. ..... 422/173; 110/173 R

[58] Field of Search ..... 422/168-183; 110/173 R, 180, 181

[56] References Cited

U.S. PATENT DOCUMENTS

| | | | |
|---|---|---|---|
| 2,605,759 | 8/1952 | Phares | 110/173 R |
| 2,703,061 | 3/1955 | Shields | 110/173 R |
| 3,499,722 | 3/1970 | Ashley | 422/173 X |
| 3,732,080 | 5/1973 | Klepitko | 422/179 |
| 3,895,918 | 7/1975 | Mueller | 422/175 |
| 3,899,303 | 8/1975 | Gaysert | 422/176 |

*Primary Examiner*—William A. Cuchlinski, Jr.
*Attorney, Agent, or Firm*—Nelson E. Kimmelman

[57] ABSTRACT

In thermal regenerative apparatus having at least one heat-exchange section which includes a plurality of ceramic refractory elements, an upstanding hatch is provided to permit additional elements to be inserted after settling of the original charge due to wide temperature fluctuations, the gas flow through them, etc. The hatch has lower, outwardly-angled surfaces to facilitate downward and outward movement of the ceramic elements as they settle thereby preventing gas flow bypass in clearances above the elements. A light cover for the hatch has a lower, flexible metal surface that enables it to maintain sealing contact despite high-temperature effects on it.

8 Claims, 4 Drawing Figures

HATCH AND HATCH COVER FOR THERMAL REGENERATION APPARATUS

BACKGROUND OF THE INVENTION

A. Field of the Invention

This invention relates to incineration and especially to thermal regenerative incinerators having a heat-exchange bed of solid discrete elements subject to shifting and subsidence over a period of time.

B. Prior Art

Thermal regeneration apparatus is known which has a plurality of heat-exchange chambers or sections around and in communication with a central high-temperature combustion zone. Each heat-exchange section has a plurality of solid, discrete heat-exchange elements such as saddle-shaped ceramic elements which are heated by very high temperature gas flow from the central zone when the gas flow is outwardly from the central zone and are cooled when the gas flow is through them into the central zone. Usually, each heat-exchange section had a generally horizontal top wall. After the initial charge of the ceramic elements into the sections, it was found that over a period of time there was a settling or subsidence of the elements due to the gas flow and the expansion-contraction effects of the heating cooling cycles. This resulted in a clearance over the top of the pile of elements through which inlet or outlet gases could bypass them. Consequently, exhaust gases from the industrial process were incompletely incinerated and gases from the central zone were passed at abnormally high temperatures through the valves and outlet ducts to the ambient atmosphere.

It is among the objects of the present invention to provide apparatus which prevents or remedies the formation of any clearance over the pile of heat-exchange elements through which inlet or outlet gases may bypass those elements. It is also among the objects to prevent undue damage to the outlet valves, ductwork and other parts of the apparatus through which abnormally hot exhaust gases flow after passing through that clearance. Still another object is the prevention of emission of incompletely incinerated industrial process gases to the ambient atmosphere.

BRIEF SUMMARY OF THE INVENTION

An upstanding hatch from the generally horizontal top wall of a heat-exchange section is provided having at its lower ends outwardly angled surfaces of at least about 30° to the vertical. It is topped by a hatch cover having a lower portion which engages the top of the hatch and is flexible enough to expand or contract in response to high-heat variations without lateral displacement sufficient to break sealing contact with the top of the hatch.

DETAILED DESCRIPTION OF THE DRAWINGS

Referring now to FIGS. 1–4, there is shown a portion of the regenerative, thermal oxidation apparatus constructed generally according to the teachings of U.S. Pat. No. 3,895,918 issued to James H. Mueller on July 22, 1975 and entitled High Efficiency Thermal Regeneration System. In that patent, three heat-exchange chambers are positioned 120° apart around a central, high temperature combustion chamber. Each chamber includes a large number of heat-retaining ceramic elements or "stones" retained in a bed bounded, in part, by outer and inner perforated walls, grills, louvers, or equivalent through which, in succession, a waste gas is passed from an external industrial process to the central combustion chamber.

Figure 1:
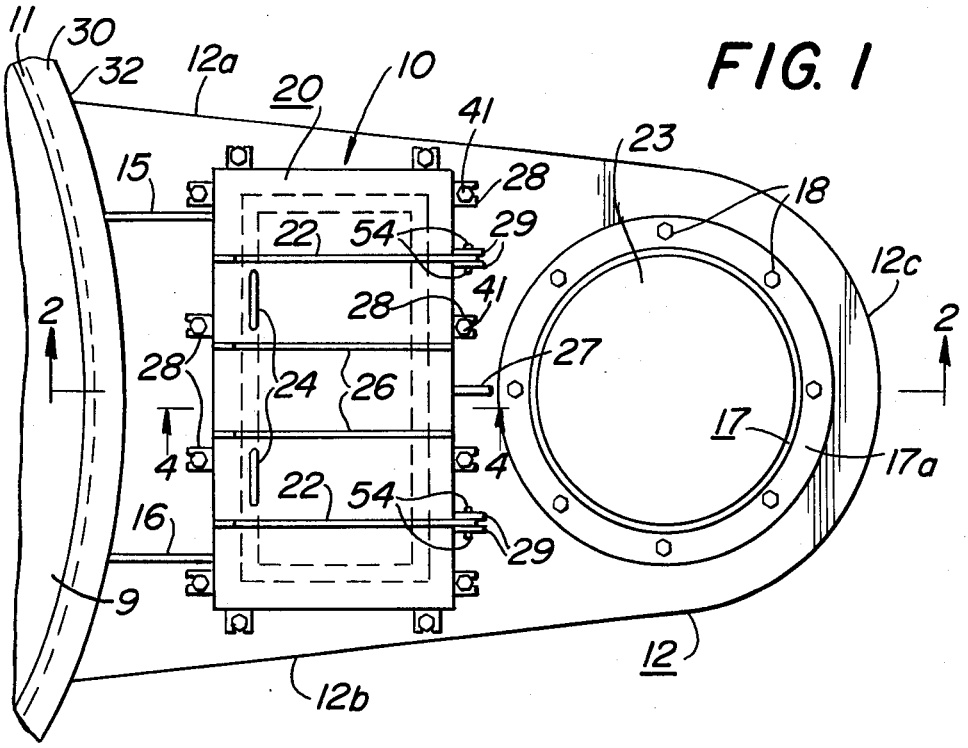
FIG. 1 is a plan view, partly fragmentary, of the inlet conduit, the heat-exchange hatch door and part of the central incineration or combustion chamber according to the present invention.
Figure 3:
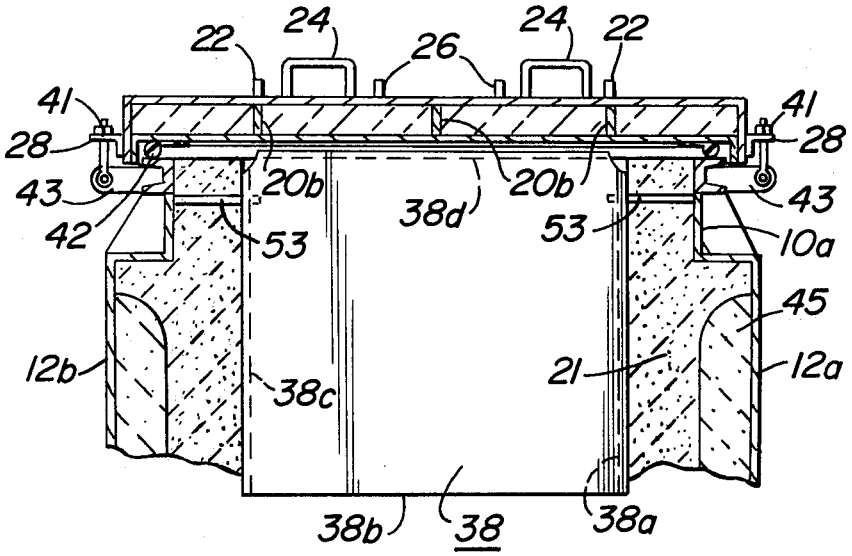
FIG. 3 is a fragmentary sectional view of part of the apparatus shown in FIG. 2 taken along the section lines 3—3 therein.

In FIG. 1, the cylindrical wall of the central combustion chamber is formed by a first or inner refractory portion 11 juxtaposed with a second refractory wall 30 and an outer metallic skin portion 32.

The heat-exchange operation is performed within the space bounded by non-parallel vertical metal walls **12*a* and 12*b* which are joined by a curved portion 12*c*. They are lined with two layers of refractory materials 45 and 21 respectively which may be the same as those of the walls 30 and 11 of the central combustion chamber. The layers 21 and 30 are made of a low density refractory material sprayed onto the interior surfaces of the metal walls 12 and 32. The inner layers 11 and 21** are made of a hard and dense refractory material.

The industrial process gas to be purified comes in via the inlet duct 17 and then moves left (FIG. 2) through plenum 6, the perforated outer retaining wall 5, through the ceramic heat-exchange elements 7, through inner perforated wall 8 and into central chamber 9. The heat-exchange bed section 10 has an upwardly-extending hatch portion **10*a* covered by a hatch cover 20. The hatch 10*a* communicates with the space into which the heat-retaining stones 7 are inserted from above. Hatch cover 20 is mounted to pivot to an open position when the handles 24 are pulled upwardly. Rigid bars 22 are attached to the top of cover 20 whose right ends curve downward and are provided with slots 22*a* through which pivot pins 54 are passed. These pins also pass through apertures in brackets 29 attached to the right side of hatch 10*a*. Handles 24 mounted to the top of the hatch cover allow the hatch cover to be pivoted upwardly when the hatch cover 20 is not battened down by the pivoting retaining bolts 41 whose upper-threaded extremities pass through the bifurcated horizontal tabs 28 and fixed position by tightening the nut-washer combinations 55 as shown in greater detail in FIG. 4. The lower ends of the bolts 41 are fixed to horizontal projections 43 which jut outwardly from the hatch side channel members 44**.

In the regenerative thermal oxidation apparatus described in the said Mueller patent, there was a generally toroidal inlet duct which communicated via down ducts with the heat-exchange sections disposed around the central combustion zone. One such down duct is shown at 17 (FIG. 2) having a flange **17*a* which is bolted to the top of the heat exchange section by bolts 18. Retaining nuts are screwed about the lower ends of the bolts 18. Between the inlet ducts 17 and the inlets to the chamber plenum 6 located outwardly of the heat-exchange bed 7** is a disc valve 23 to whose diameter a rotating shaft 23 is attached.

Figure 2:
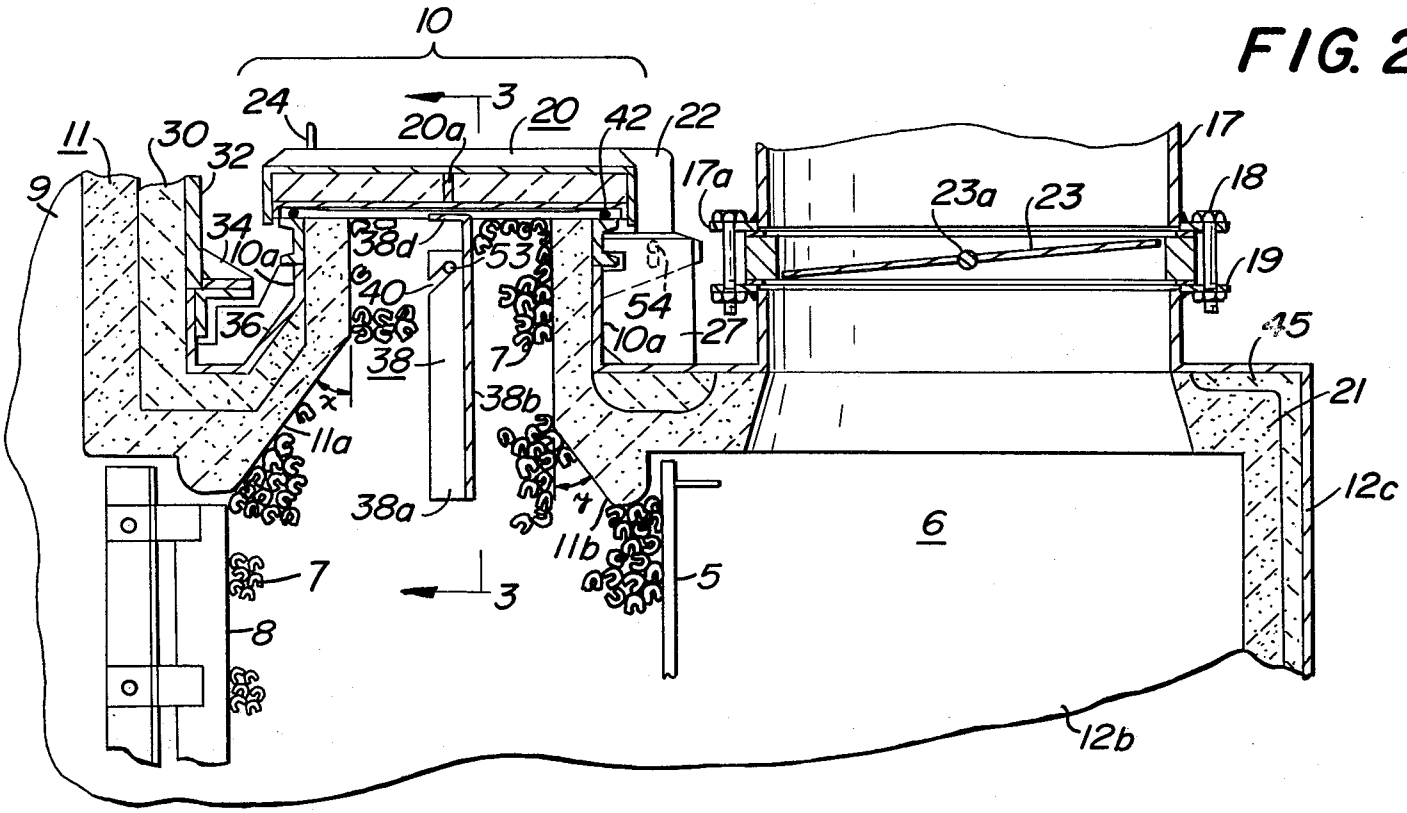
FIG. 2 is a fragmentary, sectional view taken along the section lines 2—2 of FIG. 1 in the direction indicated.
Figure 4:
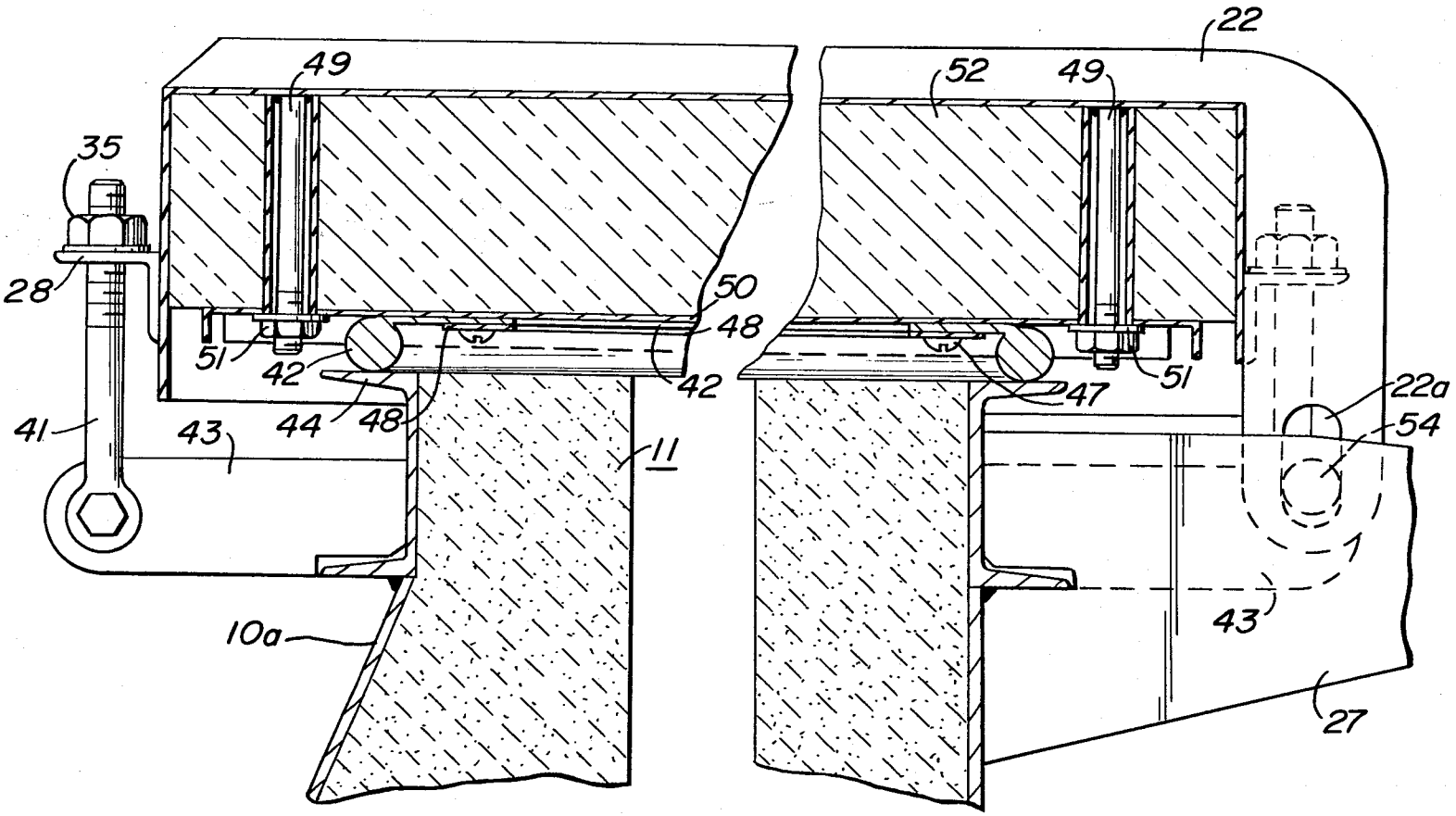
FIG. 4 is a fragmentary, sectional view taken along the section lines 4–4 in FIG. 1 in the direction indicated.

The hatch 10*a*, it will be noted, has a generally rectangular cross-section and protrudes upward from the top of each of the heat-exchange sections which abut and communicate with the central combustion chamber or zone 9. The lower surfaces of its inner and outer wall portions are angled outwardly in mutually opposite directions, viz. angles x and y (FIG. 2). A hatch showing such angled lower surfaces 11*a* and 11*b* is provided because it has been found that the heat-exchanging ceramic elements 7, when initially disposed between the inner and outer perforated retaining walls 8 and 5 of each heat-exchange bed, "settle" downwardly over a period of use. This settling is caused by the pressure of the air or effluent flow through them as well as by the recurrent cycles of contraction and expansion caused by the temperature variations in the bed depending whether it is operating in its inlet or output mode. This settling may cause, for example, a mound-like configuration of the stones 7 with the top of the mound lower than their original highest level. If no hatch were provided it would be difficult because of the shapes of the stones to apply more stones so as to fill in the spaces around the peak of the mound. It is also difficult to level the top of the mound by pushing the stones in a horizontal direction.

The settling of the stones thus results in a loss of the thermal efficiency of the system if no means are found to fill up the clearance between the top level of stones in the bed. This happens because that portion of the relatively low temperature waste effluent which passes through it without encountering any stones enters the central combustion chamber at a temperature too low for the most efficient combustion of its undesired organic components. Similarly, at the output heat exchange bed some of the air heated within the central zone which would ordinarily traverse ceramic elements, instead bypasses them through the clearance so that there is a loss of regenerative heat which passes out to the exhaust. The bypassing of the outlet bed of ceramic elements means, moreover, that unusually hot air goes directly to the exhaust system. This has an adverse effect on the valves, ductwork, fan and refractory linings which results in more down time and higher maintenance costs.

Not only is there an overall loss of heat, but there may also be some unwanted emission of incompletely incinerated polluting gases into the atmosphere.

In order to maintain the heat-exchange efficiency of the system from its inception, an upstanding hatch 10*a* is provided so that, initially, it can be filled with stones to a height higher than the rest of the heat-exchange section 10 and higher than its level after subsidence or settling. Also, in order to be able to fill the spaces above the slopes of the pile of stones after it has subsided, provision of the outwardly-angled front and rear lower surfaces 11*a* and 11*b* of the hatch 10 allows the stones moving downwardly in the hatch as a result of subsidence to naturally fill up the slopes. These angled surfaces also permit easier insertion of additional stones to fill up the spaces above the slopes. Initially, the surfaces 11*a* and 11*b* were formed so that the angles x and y were large relative to the vertical, but as knowledge of the problem grew, these angles were decreased to at least about 30°. In FIG. 2, the angle y is 36° and the angle that surface 11*a* makes relative to the vertical is about the same. A practical range of such angles is about 30°–50°.

To top off the hatch 10*a*, it was recognized that a cover would be needed which would provide a good seal, be of relatively light weight to enable it to be handled easily and safely by workmen, and be able to withstand high temperatures both for the protection of operating personnel and to account for the recurrent cycles of expansion and contraction. At first, the hatch cover 20 was made principally of a thick, cast refractory material surrounded by metal of relatively thick gauge. Eventually, however, it was found that a lighter weight cover not only was quite adequate but actually gave better results. Thus, the refractory material 52 (FIG. 4) may be batts of 3" thick material such as Carborundum L0-CON having a weight of six pounds per cubic foot. The top and sides of the metallic surround the hatch lid 20 and is made, for example, of 14 gauge hot rolled steel. The bottom surface of the hatch cover consists of a metallic plate 50 which retains the refractory material 52, the plate itself being secured in place by bolts 49 welded to the top and having nuts 51 screwed on to their lower threaded extremities. Stiffening bars 20*b* are disposed between the top and bottom of the cover 20 at spaced intervals.

The effective sealing of the hatch cover with the top edges of the hatch 10*a* is provided by a "tadpole" seal 42 capable of resisting 1400° F. or equivalent and made of a resilient type asbestos, for example. This seal is disposed in a rectangular pattern and is retained in place by a metallic retainer strip 48 in a rectangular form which is held in place by self-tapping screws 47 that pass through holes in bottom plate 50 as well as in the tadpole seal. Originally it was thought that this plate would have to be a heavy gauge steel, but after some trials, it was found that if the lower plate could not buckle or "give" in the heating cycle phase, its geometric integrity would be violated, it would expand laterally, and the seal would be broken. Therefore, a lighter gauge steel, on the order of 18 gauge stainless steel was found to be superior. By providing that the lower plate 50 be thin and flexible, expansion of the plate due to the hot cycle may cause some buckling or flexion of its central portion without displacing the tadpole seals and associated parts laterally. Thus, the seal remains intact so that the noxious industrial effluent cannot escape the heat-exchange section 10.

To further prevent the possibility of effluent gases by-passing the heat-exchange bed in the clearance above the surface of the stones 7, a metallic baffle 38 may be provided. Assembly 38 has a top, bent-over portion 38*d* and notches 40 formed in its side portions 38*a* and 38*c* which are joined to the back 38*b*. These notches engage horizontal pins 53 embedded in the refractory layers 21. The baffle assembly 38 extends downward the length of the hatch, its lower edge being roughly even with the tip of the shoulders formed at the lower extremities of the angled surfaces 11*a* and 11*b*. This baffle is to insure against any effluent or exhaust gas by-passing the ceramic stones 7 in the hatch if a clearance develops above them. This helps to insure that the gas flow has the proper dwell time in the heat-exchange beds.

The provision of a hatch extending upwardly from the heat-exchange section and having lower forward and rearward, outwardly angled surfaces has been found highly effective in maintaining the thermal efficiency of the regenerative heat incineration system described. By capping the hatch with a lightweight, heat-insulated cover whose lower sealing surface is flexible, optimum efficiency can be attained without appreciable emission of noxious or other gases from the heat-exchange section.

What is claimed is:

1. in apparatus for thermal regenerative processing of gas flow having at least one heat-exchange section in communication with a source of gas flow on one side and a high temperature chamber on the other, said section having a plurality of heat-exchanging solid members disposed therein and being bounded on top by a generally horizontal wall, the combination comprising:

(a) a hatch extending upwardly from said wall, said hatch having side walls which toward their lower ends are slanted outwardly to form angles of at least about thirty degrees with respect to the vertical, and (b) a cover for said hatch having a flexible sheet metal lower portion which engages the top edge of said hatch and is constructed to respond to the high temperature within said heat-exchange section without appreciable lateral displacement of said lower portion thereby enabling it to maintain sealing contact with said top edge.

2. The combination according to claim 1 wherein said hatch cover is mounted to be opened or closed pivotally.

3. The combination according to claim 1 wherein said angles are in the range of about 30°–50°.

4. The combination according to claim 1 wherein said hatch cover has a bottom portion which is made of a relatively thin flexible metal to which a heat-resistant compressible seal is attached, said flexible metal allowing it to deform under high heat conditions without displacing said seal laterally to such an extent that the seal is broken.

5. In apparatus for thermal regenerative processing of gas flow having at least one heat-exchange section in communication with a source of gas flow on one side and a high temperature chamber on the other, said section having a plurality of heat-exchanging solid members disposed therein and being bounded on top by a generally horizontal wall, the combination comprising:

(a) a hatch extending upwardly from said wall, said hatch having front and back refractory walls which toward their lower ends are provided with substantially planar surfaces angled outwardly to form angles of at least about thirty degrees with respect to the vertical, and (b) a cover for said hatch which may be moved to enable access to the interior of said hatch.

6. In apparatus for thermal regenerative processing of contaminated gas flow from industrial or commercial installations, said apparatus having at least one heat-exchange section in communication with a source of gas flow on one side and a combustion chamber in which a very high temperature is produced on the other, said section having a plurality of heat-exchanging solid members disposed therein and being bounded on top by a generally horizontal wall from which a hatch extends upwardly, said hatch communicating with said section, a cover for said hatch having a flexible lower portion which engages the top edge of said hatch and is constructed to respond to the high temperature within said heat-exchange section without appreciable lateral displacement of said lower portion thereby enabling it to maintain sealing contact with said top edge.

7. A cover for a hatch used in thermal regenerative processing apparatus for decontamination of contaminated gas flow from industrial or commercial installations having at least one heat-exchange section in communication with a source of gas flow on one side and a combustion chamber in which a very high temperature is produced on the other, said cover comprising:

(a) metallic walls on top and sides of said hatch cover, (b) insulating material within said metallic walls, and (c) a flexible metallic lower portion for engaging the top edge of said hatch and constructed to respond to the very high temperature produced in said combustion chamber without appreciable lateral displacement of said lower portion thereby enabling it to maintain sealing contact with said top edge.

8. The hatch cover according to claim 7 wherein said lower portion comprises a relatively thin sheet of metal, a compressible heat-resistant seal disposed adjacent the lower surface of said lower portion, and a metallic retaining strip below said seal and fixed to said relatively thin metal sheet.

* * * * *